US005475922A

United States Patent [19]

Tamura et al.

[11] Patent Number: 5,475,922

[45] Date of Patent: Dec. 19, 1995

[54] METHOD OF ASSEMBLING A CONNECTOR USING FRANGIBLE CONTACT PARTS

[75] Inventors: Akira Tamura; Hidehisa Sakai; Mikio Nishihara; Kyoichiro Kawano, all of Kawasaki, Japan

[73] Assignee: Fujitsu Ltd., Kawasaki, Japan

[21] Appl. No.: 306,474

[22] Filed: Sep. 15, 1994

Related U.S. Application Data

[62] Division of Ser. No. 98,852, Jul. 29, 1993, Pat. No. 5,354, 209.

[30] Foreign Application Priority Data

Dec. 18, 1992 [JP] Japan ..... 4-339102

[51] Int. Cl.[6] ..... H01R 43/20; H01R 13/193

[52] U.S. Cl. ..... 29/881; 29/413; 29/882

[58] Field of Search ..... 29/413, 881, 882, 29/884; 439/263, 265, 266, 268, 270, 682, 686, 733

[56] References Cited

U.S. PATENT DOCUMENTS

| | | | |
|---|---|---|---|
| 3,779,515 | 12/1973 | Larins et al. | 254/16 |
| 3,939,546 | 2/1976 | Hernandez | 29/278 |
| 4,217,024 | 8/1980 | Aldridge et al. | 439/733 X |
| 4,546,542 | 10/1985 | Proud | 29/882 X |
| 4,614,395 | 9/1986 | Peers-Trevarton | 29/881 X |
| 4,621,791 | 11/1986 | Staskiawicz et al. | 254/17 |
| 4,683,631 | 8/1987 | Dobbertin | 29/278 |
| 4,815,987 | 3/1989 | Kawano et al. | 439/263 |
| 4,904,212 | 2/1990 | Durbin et al. | 439/751 |
| 5,190,266 | 3/1993 | Barnera | 254/17 |
| 5,269,494 | 12/1993 | Pittman et al. | 254/17 |

FOREIGN PATENT DOCUMENTS

| | | | |
|---|---|---|---|
| 2631107 | 2/1977 | Germany . | |
| 2620757 | 11/1977 | Germany | 29/882 |
| 52530 | 3/1982 | Japan | 29/882 |
| 55806 | 3/1991 | Japan | 29/882 |

OTHER PUBLICATIONS

Williams "Zero Insertion Force Module Socket" IBM Technical Disclosure Bulletin vol. 22, No. 5, Oct. 1979, pp. 1870–1871.

*Primary Examiner*—Peter Vo

*Attorney, Agent, or Firm*—Armstrong, Westerman Hattori, McLeland & Naughton

[57] ABSTRACT

A contact pin includes: a pin terminal secured to a stationary base art by press-fitting a press-fitted part into the stationary base part, the pin terminal projecting from the stationary base part and being joined to the board; a contact part inserted into a contact pin through-hole of a movable lock part so that a plug pin terminal is fitted into the contact part; and an auxiliary plate 6 reinforcing the press-fitted part, engaged with the movable lock part and transmitting a force caused by a movement of the movable lock part to the press-fitted part. A connector constructed in the described manner includes a plurality of above-mentioned contact pins.

4 Claims, 7 Drawing Sheets

METHOD OF ASSEMBLING A CONNECTOR USING FRANGIBLE CONTACT PARTS

This is a division of application Ser. No. 08/098,852 filed Jul. 29, 1993 now U.S. Pat. No. 5,354,209.

BACKGROUND OF THE INVENTION

The present invention relates to a connector used to connect two members of an electronic apparatus, and to a method of assembling the same. The present invention relates, more particularly, to a connector having a large number of plug pins or contact pins (hereinafter, generically referred to as "pin terminals"), and to a method of assembling such a connector.

Recently, electronic apparatuses, such as computers, have come to have higher concentration of components and, tires, the number of I/O terminals for electronic signals has increased with a result that the number of pin terminals in a connector has also increased. Since it is required that the dimension of a connector be not larger than a conventional size, the dimension of each individual pin terminal has come to be reduced.

Therefore, the mechanical strength of a pin terminal with respect to external force has become smaller than before. Hence, a chance has increased that pin terminals can be bent or broken during a process of assembling a connector, thus reducing a yield of produced connectors.

Accordingly, a connector in which pin terminals are not damaged during assembly, as well as a method of assembling such a connector, have been desired.

A conventional connector for use in a motherboard is configured such that a plurality of contact pins having a male pin terminal to be joined to the board and a female contact part are provided between a movable lock part and a stationary base part. The connector is used in such a manner that the pin terminal to be joined to the board is made to project through the stationary base part so as to be joined to the motherboard, and the contact part mated with in the movable lock part is connected to a pin terminal of a plug. Conventionally, this connector has been assembled in the following manner.

A contact pin is made of a material having good conductivity, such as copper. A pin terminal to be connected to the motherboard is formed on one end of the contact pin, and an elastically deformable part, including a contact part to be engaged with the plug pin terminal, is formed on the other end thereof.

A connector case for holding a plurality of contact pins is made of an insulating material, such as a resin. The connector case comprises: a stationary base part having pin terminal through-holes for allowing the pin terminal to project toward the motherboard; and a movable lock part having contact pin through-holes for holding the contact part and the elastically deformable part so that the contact part is engaged with the plug pin terminal inserted into those parts.

The plurality of contact pins constituting the connector are inserted into the pin terminal through-holes of the stationary base part and are press-fitted by means of a jig before being soldered to the motherboard. The contact part and the elastically deformable part of the plurality of contact pins are inserted into the contact pin through-hole of the movable lock part.

A problem with the above-mentioned conventional connector and with the method of assembling the same is that, since there are needed a process of inserting the plurality of contact pins into the pin terminal through-holes of the stationary base part, a specially made jig for press-fitting the plurality of contact pins thus inserted; and a process of soldering the contact pins to the motherboard, the cost for producing the contact pins becomes relatively high due to a need to fit the contact pin to the jig and due to the soldering process.

The material forming the contact pin and having good conductivity is often a metal having good workability. It is also to be noted that an individual contact pin constituting the connector has become small due to high concentration of components in recent electronic devices. These factors, i.e. the workability of the material and the reduced size, causes a problem that the contact pin can be bent or broken during the press-fitting process, thus possibly reducing the yield of the produced contact pins.

Still another problem with the conventional art is that, since the contact part of the contact pin is formed to open out so that the plug pin terminal inserted externally can be easily fitted thereinto, it requires effort to insert the contact pin through the contact pin throughhole in a connector assembling process, and the contact part or the contact pin through-hole can be damaged while the contact pin is being inserted.

SUMMARY OF THE INVENTION

The present invention has been developed in view of the above problems, and its object is to provide a connector and a method of assembling the same, according to which the fitting of the contact pin into the movable lock part and into the stationary base part can be easily carried out without damaging any part.

In order to achieve the above object, the connector according to the present invention is configured such that a press-fitted part, formed in each of a plurality of contact pins into which a plurality of external electrode terminals are fitted, is press-fitted into each of a plurality of pin terminal through-holes provided in a stationary base part, such that the plurality of electrode terminals fitted into the plurality of contact pins are locked or unlocked in correspondence with a movement of a movable lock part movably assembled to the stationary base part.

Consequently, an auxiliary plate reinforcing the press-fitted part and engaged with the movable lock part is provided in each of the plurality of contact pins, and a force caused by the movement of the movable lock pan is transmitted to the press-fitted part via the auxiliary plate when the press-fitted part of each of the plurality of contact pins is press-fitted into each of the plurality of pin terminals through-holes in correspondence with the movement of the movable lock part.

The method of assembling the connector according to the present invention comprises the steps of:

a) temporarily inserting a plurality of contact pin composites, each including: a pin terminal to be joined to a board; a contact part into which an external electrode terminal is fitted; and an assembly-aiding part generally shaped to have a sharp edge and provided at the end of the contact part, into a plurality of contact pin through-holes provided in a movable lock part; and b) inserting with a force the assembly-aiding part and the contact parts into each of the plurality of contact pin through-holes, as well as detaching the assembly-aiding part from the contact part so that a plurality of contact pins are formed.

According to the above-described first aspect of the present invention, the press-fitted part of the contact pin is reinforced by the auxiliary plate engaged with the movable lock part, and the force caused by the movement of the movable lock part is transmitted to the press-fitted part via the auxiliary plate. Hence, the force is not exerted upon the parts, other than the press-fitted part of the contact pin, thereby preventing bent or broken contact pins from being produced.

According to the above-mentioned second aspect of the present invention, the contact pin is formed by inserting with a force the plurality of contact pin composites, including the assembly-aiding part, generally shaped to have a sharp edge, into the plurality of contact pin through-holes of the movable lock part before detaching the assembly-aiding part. Hence, the insertion of the contact pin into the contact pin through-hole becomes easy to perform in an assembly of the connector, and a contact pin insertion process and an assembly-aiding part detaching process, which processes are conventionally executed independently, can be executed substantially at the same time.

Other objects and further features of the present invention will be apparent from the following detailed description when the read in conjunction with the accompanying drawings.

DESCRIPTION OF THE PREFERRED EMBODIMENT

Figure 1A:
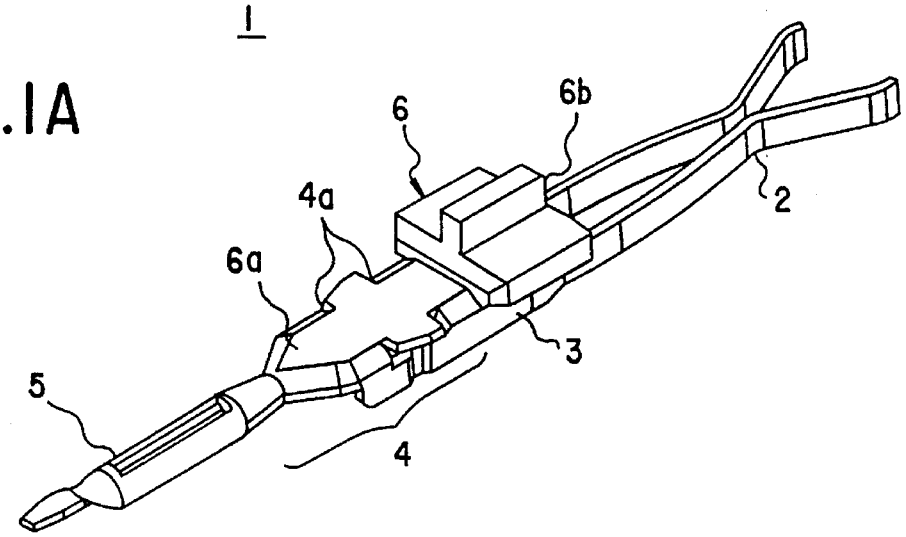
FIGS. 1A and 1B are perspective views which show opposite sides of a construction of a contact pin constituting a connector of the present invention.
Figure 1B:
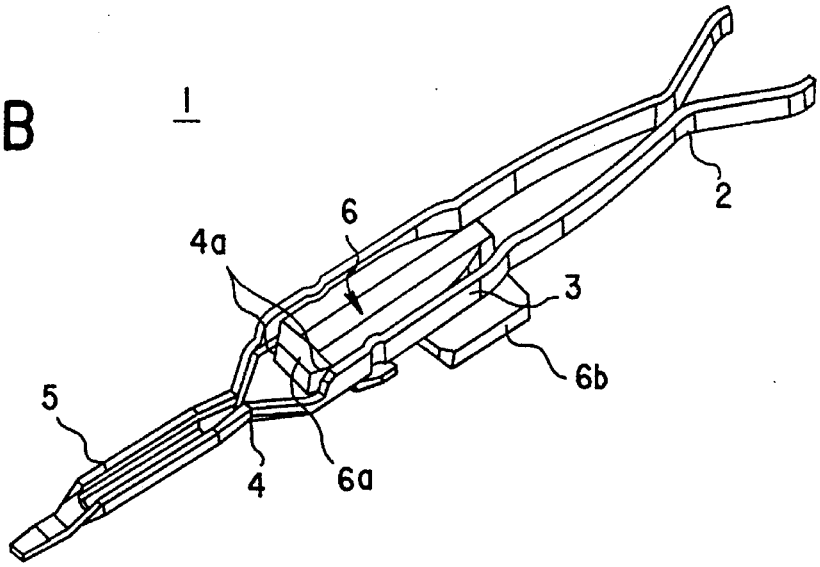

FIG. 1 shows the configuration of the contact pin constituting the connector, according to the present invention. FIGS. 1A and 1B are perspective views of the contact pin taken from opposite sides thereof. In the figures, 1 indicates a contact pin, 2 a contact part, 3 an elastically deformable part, 4 a press-fitted part, 4*a* a holding-and-engaging part, 5 a pin terminal to be joined to the board, 6 an auxiliary plate, 6*a* a held part, and 6*b* a pressed part. The exploded perspective view of FIG. 2 and the top view of FIG. 3 show an embodiment of the connector according to the present invention, in which 10 indicates a connector, 11 movable lock part, 11*a* a movable guide, lib a cam-guiding groove, 110 a contact pin through-hole, 12 a stationary base part, 12*a* a stationary guide, and 120 a pin terminal through-hole.

Referring to FIGS. 1A and 1B, the contact part 2, the elastically deformable part 3, the press-fitted part 4 and the pin terminal 5 to be joined to the board are integrally formed of a material having good conductivity. The; auxiliary plate 6 is formed, for example, of a resin not easily deformed by external force.

The pin terminal 5, having a rod shape, serves as a terminal to be connected to the motherboard (not shown) by projecting out of the stationary base part 12 as the contact pin 1 is press-fitted into the pin terminal through-hole 120 provided in the stationary base part 12. Hence, the end of the pin terminal 5 is generally shaped to have a sharp edge so that the pin terminal 5 can be easily inserted into the pin terminal through-hole 120 and into a connection hole provided in the motherboard.

The body of the pin terminal 5 has a shape of a halved column, the surface of the halved column being provided with a rectangular through-groove aligned with a line connecting the end of the pin terminal 5 and the press-fitted part 4. This rectangular shape of the groove makes the pin terminal 5 less deformable against external force exerted along the longitudinal direction of the pin, and causes the pin terminal 5 to be deformed toward the center of the pin when the pin is press-fitted into the pin terminal through-hole 120.

The press-fitted part 4 is provided for press-fitting the contact pin 1 into the pin terminal through-hole 120, and also serves as a boundary between the pin terminal 5 and the elastically deformable part 3. The contact pin 1 is press-fitted as far as a predetermined position of the pin terminal through-hole 120 so as to be in contact with the interior of the pin terminal through-hole 120. In this way, the contact, pin 1 is secured into the stationary base part 12.

The elastically deformable part 3 comprises two blade springs provided opposite each other, the fixed ends of the blade springs being integrated with the press-fitted part 4. Near the fixed ends of the blade springs, the holding-and-engaging part, defined by oppositely projecting wings forming opposed shoulders 4*a*, is provided and abuttingly receives the auxiliary plate 6. The held part 6*a* of the auxiliary plate 6 is fitted to the holding-and-engaging part 4*a*. Near the free ends, the gap between the two blade springs narrows so as to form the contact part 2. The contact part 2 is inserted into the contact pin through-hole 110 provided in the moveable lock part 11 described later.

The auxiliary plate 6 comprises the held part 6*a* and the pressed part 6*b*. The held part 6*a* is held by the holding-and-engaging part 4*a*, as described previously, and reinforces the press-fitted part 4. The cross-section of the pressed part 6*b* facing the pin terminal 5 is made to have a T-shape. The pressed part 6*b* engages the movable lock part 11 when the movable lock part 11 is moved downwardly toward the stationary base part 12 as represented in FIG. 2.

Therefore, when movement of the movable lock part 11 occurs with respect to the stationary base part 12, the force caused thereby is exerted upon the pressed part 6*b* of the auxiliary plate 6 and is transmitted to the press-fitted part 4 of the contact pin 1 via the held part 6*a* and the holding-and-engaging part 4*a*. This force causes the press-fitted part 4 to be urged into the generally rectangularly formed pin terminal through-hole 120 of the stationary base part 12 as indicated in FIG. 2.

This force is not exerted upon the part of the contact pin 1 other than the press-fitted part 4 which is reinforced by the auxiliary plate 6, so that the contact pin can be prevented from being bent or broken. In other words, the parts other than the press-fitted part 4 can be prevented from being deformed of damaged when the press-fitted part 4 is urged by pressing into the pin terminal through-hole 120 of the stationary base part 12.

Figure 2:
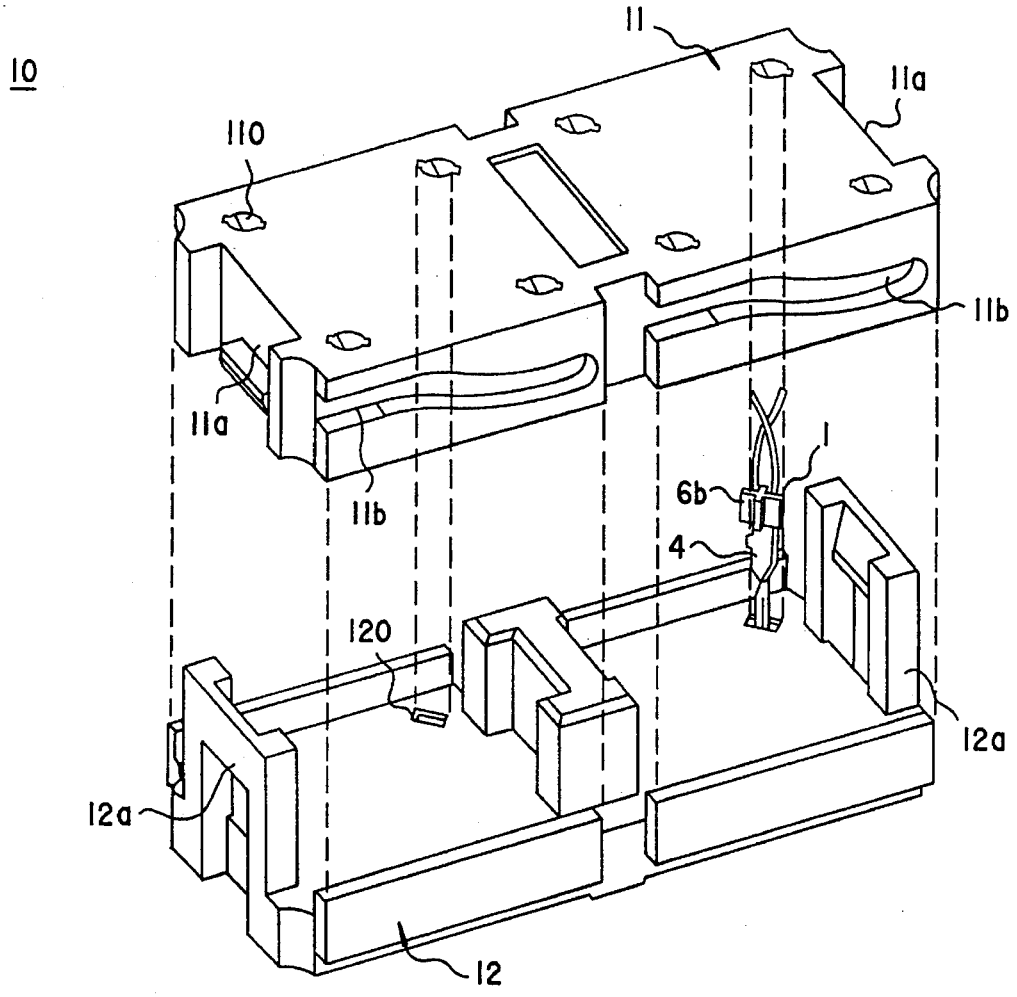
FIG. 2 is an exploded perspective view of an embodiment of the connector according to the present invention.
Figure 3:
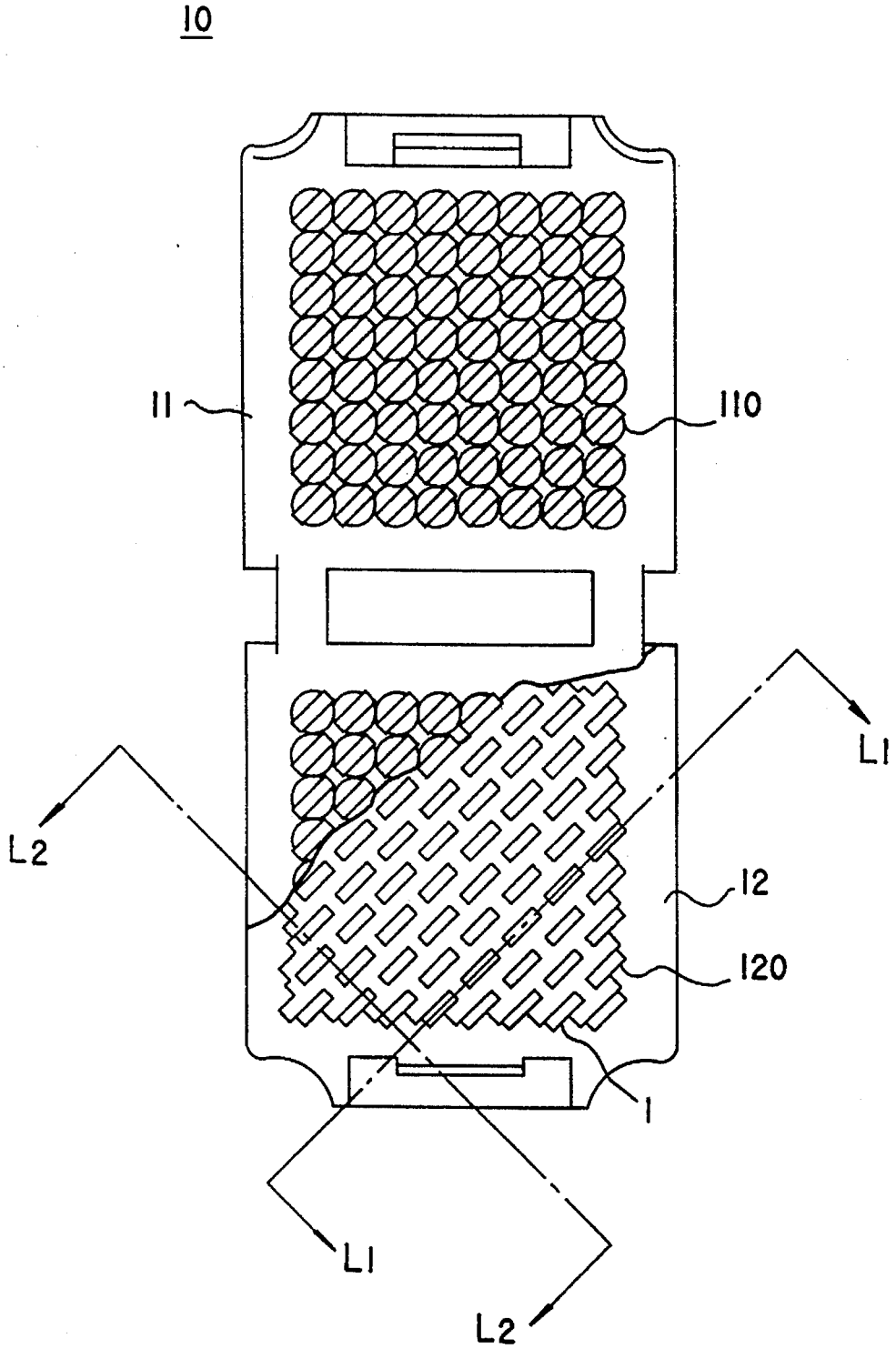
FIG. 3 is a top view of an embodiment of the connector according to the present invention.

Referring to FIGS. 2 and 3, the contact pin through-holes 110 are arranged in the movable lock part 11 in a way that a top view of the movable lock part 11 shows the contact pin through-holes 110 arranged in two generally square areas next to each other. In each of the generally square areas, a predetermined number of contact pin through-holes 110 are laid out in a grid pattern. The pin terminal through-holes 120 are also arranged in the stationary base part 12 in two generally square areas next to each other. In the illustrated arrangement, a total of 128 pin terminal through-holes 120 are laid out in vertical alignment with the corresponding contact pin through holes 110 in the movable lock part 11.

The longitudinal end faces the, movable lock part 11, which faces flank the surface on which the contact pin through-holes 110 are arranged, are provided with movable guides 11*a*. The longitudinal end faces of the stationary base part 12, which faces flank the surface on which the pin terminal through-holes 120 are arranged, are provided with stationary guides 12*a*. As indicated in FIG. 2, the movable guides 11*a* and the stationary guides 12*a* cooperate to movably engage each other while a total of 128 contact pins 1 are being housed between them. In this way, the distance between the contact pin through-holes 110 and the pin terminal through-holes 120 can be adjusted within a predetermined range.

As shown best in FIG. 2, the lateral sides of the movable lock part 11 are each provided with two cam-guiding grooves 11*b*. The cam-guiding grooves 11*b* extend in the longitudinal direction of the movable lock part 11. As shown in FIG. 2, each groove has an open end at one extreme that is slightly elevated with respect to a closed end at the other extreme. The cam-guiding grooves 11*b* serve as a part of a locking mechanism described below and are used when the movable lock part 121 is moved with respect to the stationary base part 12.

Figure 4A:
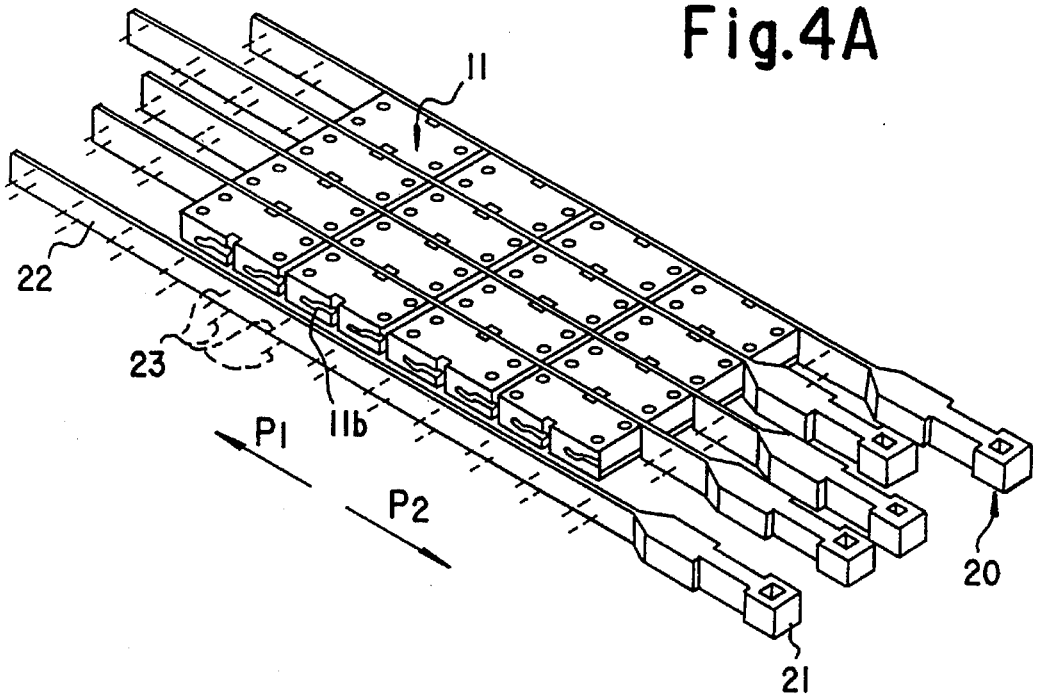
FIG. 4A is a perspective view of illustrating a locking mechanism to which the connector of FIG. 3 is applied.
Figure 4B:
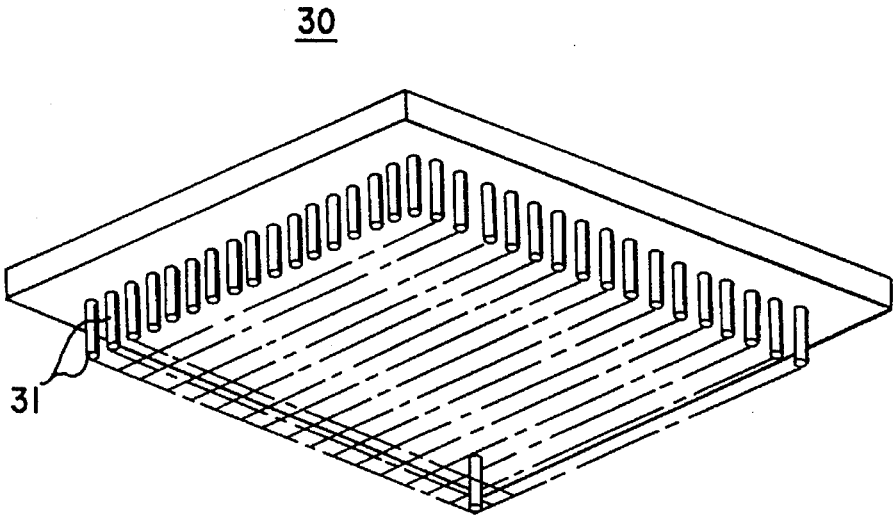
FIG. 4B shows a plug that is locked.

FIGS. 4A and 4B show the locking mechanism to which the connector of FIG. 3 is applied, and plugs locked by operating this locking mechanism, respectively. FIG. 4A shows the locking mechanism, and FIG. 4B shows the plugs, which plugs are locked after being fitted into the connector 10. In the figures, numeral 10 indicates the connector, numeral 20 the locking operation means, and numeral 30 the plugs.

Referring to FIG. 4A, the locking operation means 20 comprises: an operation part 21 for operating the locking mechanism; a slide cam 22 for allowing the movable lock parts 11 of a plurality of connectors 10 to be simultaneously moved with respect to the stationary base part 12; and a cam projection 23 indicated by dotted lines to be engaged with the respective cam-guiding grooves 11*b*.

The cam-guiding grooves 11*b* formed on the lateral sides of the plurality of connectors 10 arranged as shown in the figure are engaged with a plurality of cam projections 23 of a plurality of slide cams 22.

Referring to FIG. 4B, a predetermined number of plug pin terminals 31 (corresponding to external electrodes in the claims) are provided in the plug 30 so as to be directly opposite to the corresponding contact pins arranged in the connector 10 shown in FIG. 4A. The plug pin terminals 31 are coupled to the contact pins.

It will be appreciated from examination of FIG. 4A that, when an external force is exerted upon the operation part 21 in a direction indicated by the arrow P1 so that the slide cam 22 is moved in the direction indicated by the arrow P1, the movable lock part 11 is caused to be moved away from the stationary base part 12 because the cam projection 23 becomes engaged with the cam-guiding groove 11*b* causing the movable lock part to be raised with respect to the stationary base part near the lower end of the groove.

When an external force is exerted upon the operation part 21 in a direction indicated by an arrow P2 so that the slide cam 22 is moved in the direction indicated by the arrow P2, the movable lock part 11 is caused to be moved close to the stationary base part 12 because the cam projection 23 becomes engaged with the cam-guiding groove 11 b near the upper end of the groove.

Figure 5A:
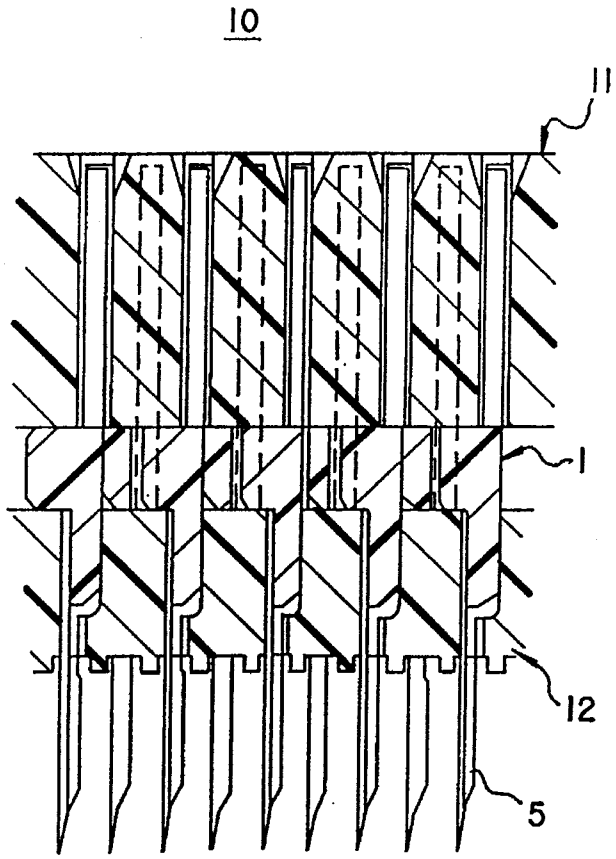
FIG. 5A and 5B are cross-sectional views taken along lines $L_1$—$L_1$ and $L_2$—$L_2$, respectively, of FIG. 3.
Figure 5B:
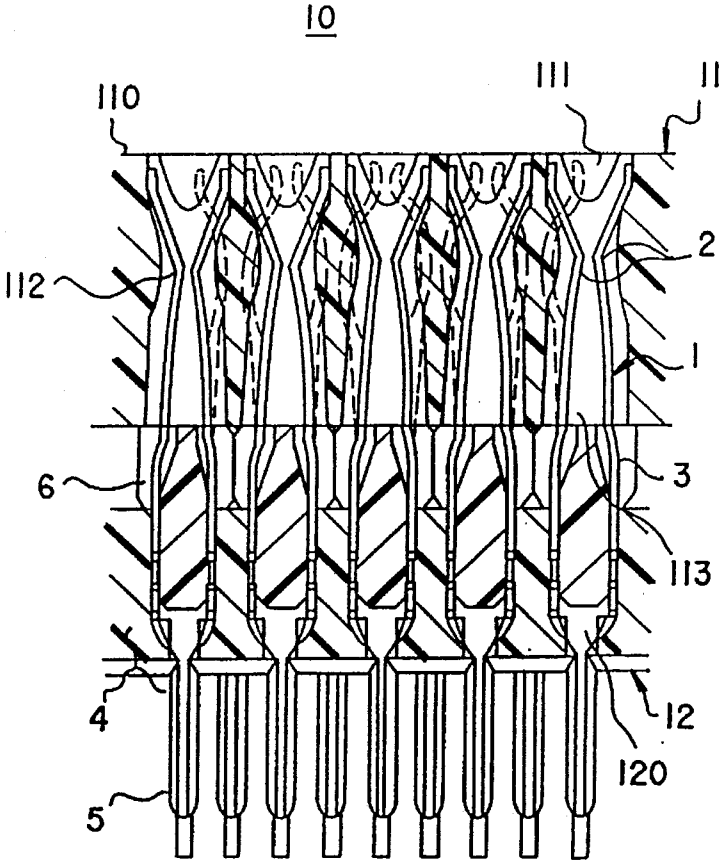

FIGS. 5A and 5B are cross-sections of the connector of FIG. 3. FIG. 5A is a cross-section taken along the line L1—L1 of FIG. 3. FIG. 5B is a cross-section taken along the line L2—L2 of that figure. In the figures, those parts that are identical to the parts of FIGS. 1–3 are designated by the same reference numerals, and the description thereof is omitted. Numerals 111,112 and 113 in FIG. 5B indicate, respectively, an opening part, a narrowed part and an inner part, each constituting the contact pin through-hole 110. In FIGS. 5A and 5B, the movable lock part 11 is shown to have been moved, by operating the locking mechanism to a position nearest the stationary base part 12.

Referring to FIG. 5A, the contact pin 1 is press-fitted into the pin terminal through-hole 120 provided in the stationary base part 12 and allowed to project therefrom, the press-fitted part 4 securing the contact pin 1 at a predetermined position in the pin terminal through-hole 120.

The auxiliary plate 6 is positioned between the movable lock part 11 and the stationary base part 12. When the movable lock part 11 is moved close to the stationary base part 12 and comes in contact with the auxiliary plate 6, any force caused by such contact is transmitted to the press-fitted part 4 via the auxiliary plate 6. As described previously, in this way the press-fitted part 4 is reinforced by the auxiliary plate 6 so that the contact pin 1 is less likely to be damaged than otherwise.

As shown in FIG. 5A, the inside of the contact pin through-hole 110 has a shape similar to the shape of the elastically deformable part 3 of the contact pin 1. That is, as can be seen in FIGS. 5A and 5B, the contact pin through-hole 110 is narrowed to form the narrowed part 112 near the contact parts 2 of the contact pin 1, into which part the externally inserted plug pin terminal is fitted.

The inside portion of the contact pin through-hole 110 is enlarged, by small degrees, from the narrowed part 112 toward where the plug pin terminal is received via the movable lock part 11. The contact pin through-hole 110 ends in the opening part 111. This inside portion of the contact pin through-hole 110 is also enlarged, by small degrees, from the narrowed part 112 toward the press-fitted part 4. In this direction, the contact pin through-hole 110 ends in the inner part 113.

Figure 6A:
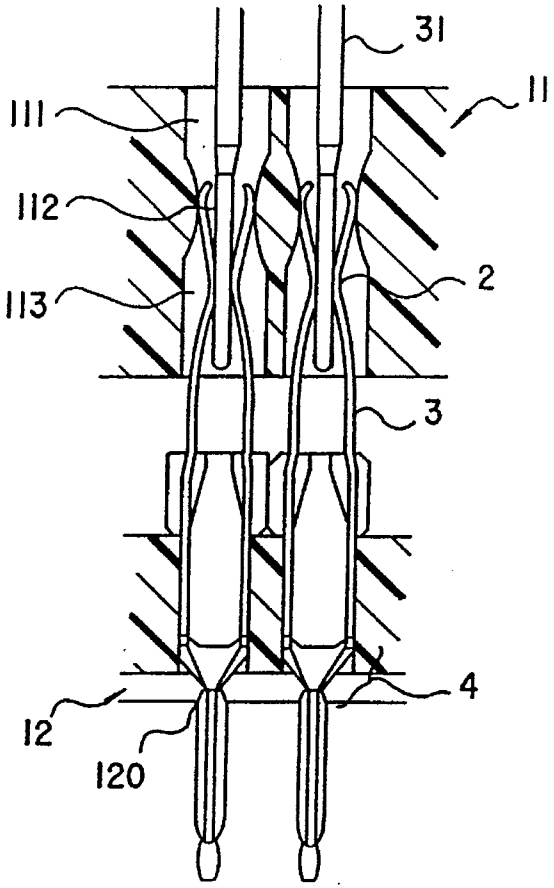
FIGS. 6A and 6B are views showing an operation of the locking mechanism of FIGS. 4A and 4B.
Figure 6B:
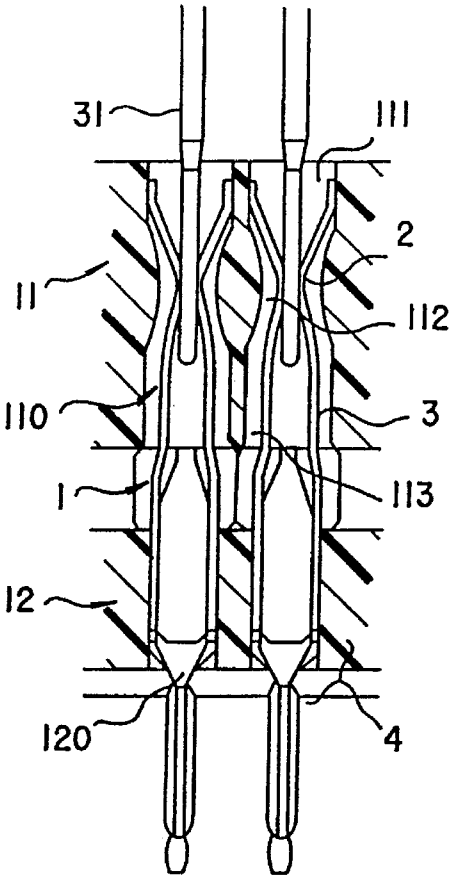

FIGS. 6A and 6B show the effects of the operation of the locking mechanism of FIG. 4A. FIG. 6B shows the movable lock part 11 in a condition in which it is moved nearest the stationary base part 12 by operating the locking mechanism. FIG. 6A shows the movable part 11 in a condition in which it is moved farthest from the stationary base part 12. In the figures, those parts that are identical to the parts of FIGS. 1–5 are given the same reference numerals and the description thereof is omitted.

In the state shown in FIG. 6B, the slide cam 22 constituting the locking operation means 20 has been moved toward the direction indicated by the arrow P2 in FIG. 4A so that the movable locking part 11 is nearest the stationary base part 12.

In this state, the contact part 2 of each contact pin 1 in the connector generally resides at the narrowed part 112 of the contact pin through-hole 110. Therefore, two blade springs constituting the elastically deformable part 3 are retaining their original shapes so that the contact part 2 of the contact pin remains opening out.

Consequently, no force that is strong enough to engage the plug pin terminal 31 with the contact pin 1 is exerted upon the contact part 2 of the contact pin 1 in this state. It is easy to fit the plug pin terminal 31 to the contact part 2 of the contact pin 1 via the opening part 111 of the movable lock part 11 and to detach the same.

In the state shown in FIG. 6A, the slide cam 22 of the locking operation means 20 shown in FIG. 4A has been moved in the direction indicated by the arrow P1 of FIG. 4A so that the movable lock part 11 is removed farthest from the stationary base part 12.

In this state, the contact part 2 of the contact pin 1 generally resides at the inner part 113 of the contact pin through-hole 110. Therefore, the end of the elastically deformable part 3 is constricted by the narrowed part 112 so that the contact part 2 is forced in a closing direction.

Consequently, a force strong enough to engage the plug pin terminal 31 with the contact pin 1 is exerted upon the contact part 2 of the contact pin 1 in this state. Hence, the plug terminal 31 inserted into the contact part 2 of the contact pin 1 via the opening part 111 of the movable lock part 11 can be locked so that the plug can be secured to the connector 10.

Figures 7A, 7B, 7C, 7D:
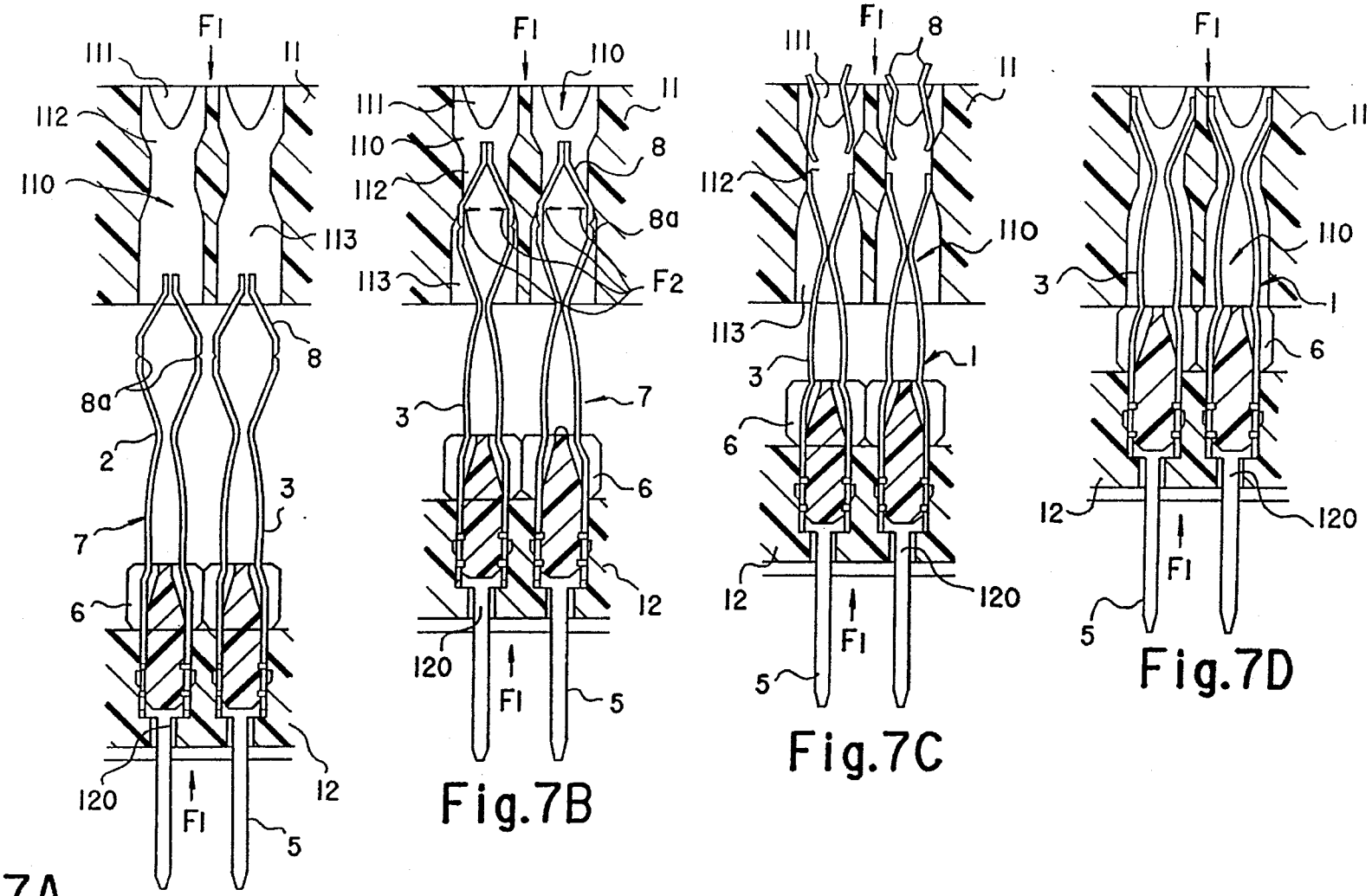
FIGS. 7A through 7D show how the connector of the present invention is assembled.

FIGS. 7A through 7D show a method of assembling the connector according to the present invention. FIG. 7A is a cross-section of the connector before it is assembled. FIGS. 7B and 7C are cross-sections taken during an assembly. FIG. 7D is a cross-section taken after an assembly. In the figures, those parts that are identical to the parts in FIGS. 1–6 are designated by the same reference numerals, and the description thereof is omitted. Numeral 7 indicates a contact pin composite, numeral 8 an assembly-aiding part, and numeral 8*a* a notch separating the assembly-aiding part from the deformable part 3.

Thus, the contact pin composite 7 is configured such that a residual dispensable part, remaining as a result of the process for working material of the elastically deformable part 3 so as to form the contact part 2 of the contact pin 1, is retained as the assembly-aiding part 8, and such that the notch 8*a* is provided between the disposable part and the part necessary for forming a contact pin, the disposable part being formed at the end of the elastically deformable part 3 and generally shaped to have a sharp edge. That is, the contact pin composite 7 is such that, if the assembly-aiding part 8 is detached from the contact composite 7, the contact pin 1 is obtained.

In the state shown in FIG. 7A, the pin terminal 5 of the contact pin composite 7 is temporarily inserted into the pin terminal through-hole 120 provided in the stationary base part 12. Further, the assembly-aiding part 8 of the contact pin composite 7 is temporarily inserted into the contact pin through-hole 110 provided in the movable lock part 11.

When a force F1 is exerted upon the movable lock part 11 so that the movable lock part 11 is moved close to the stationary base part 12, the assembly-aiding part 8 starts to be inserted further into the contact pin through hole 110, as shown in FIG. 7B.

In the state shown in FIG. 7B, the assembly-aiding part 8 of the contact pin composite 7 is in contact with the narrowed part 112 of the contact pin through-hole 110. When the contact pin composite 7 is inserted further into the contact pin through-hole 110, a laterally-constricting force F2 is exerted by the narrowed part 112 upon the part of the assembly-aiding part 8 in contact therewith.

When the contact pin composite 7 is inserted still further into the contact pin through hole 110, the notch 8*a* becomes broken when it finally fails to stand the force F2, resulting in the state shown in FIG. 7C.

Referring to FIG. 7C, when the notch 8*a* is broken due to the force F2, the assembly-aiding part 8 of the contact pin composite 7 is detached so that the contact pin 1 is formed. Since the contact part 2 of the contact pin 1 is already inserted as deep as the narrowed part 112, an act of further insertion of the contact pin 1 can be executed with the force F1 smaller in intensity than the force F2.

Referring to FIG. 7D, when the insertion of the contact part 2 into the contact pin through-hole 110 is completed, the movable lock part 11 that has been moved close to the stationary base 12 is brought into contact with the auxiliary plate 6 on the contact pin 1. As described before, when a large force F1 is exerted upon the movable lock part 11, the press-fitted part 4 is urged into the pin terminal through-hole 120 of the stationary base 12, and the pin terminal 5 to be joined to the board is allowed to project from the stationary base 12.

As has been described, the present invention makes an act of inserting the contact pin into the contact pin through-hole easy to perform during an assembly process. Moreover, two processes that have conventionally been carried out separately, i.e. the process of inserting the contact pin and the process of removing the assembling-aiding part, can be carried out at the same time. Hence, the time required for one connector to be assembled is reduced, and the efficiency of the assembly process is improved.

Other advantages of the present invention are that the number of steps required in the assembly process is reduced; the production cost is reduced; and the quality of the produced connectors is improved. This is obvious because the contact pin 1 is formed from the contact pin composite 7 as the assembly is proceeding, and because the damage to the interior of the contact pin through-hole 110 due to the contact between the contact part 2 with the interior is lessened.

According to one aspect of the present invention, the force caused by the movement of the movable lock part is not exerted upon the parts other than the press-fitted part of the contact pin 1 so that the damage, by which the contact pin may be bent or broken, can be prevented. In other words, the parts, other than the press-fitted part, can be prevented from being deformed or damaged when the press-fitted part is urged into the pin terminal through-hole of the stationary base part.

According to another aspect of the present invention, an act of inserting the contact pin into the contact pin through-hole is made easy to perform during the assembly process. Moreover, two processes that have conventionally been carried out separately, i.e. the process of inserting the contact pin and the process of removing the assembly-aiding part, can be carried out at the same time. Hence, the time required for one connector to be assembled is reduced, and the efficiency of the assembly process is improved.

The present invention is not limited to the above-described embodiment, and variations and modifications may be made without departing from the scope of the present invention.

What is claimed is:

1. A method of forming a connector by assembling a plurality of contact pin composites, each including a pin terminal to be joined to a board and a contact part for receiving an external electrode terminal, comprising the steps of:

providing a stationary base part having a plurality of holes for receiving the pin terminals of the respective contact pin composites;

providing a movable lock part having a plurality of holes aligned with the respective pin terminal-receiving holes of said stationary base part for receiving the contact parts of the respective contact pin composites;

providing each said contact part at the end thereof with a frangible assembly-aiding part;

inserting the pin terminal of each composite into a cooperating hole in said stationary base part;

locating the ends of said contact parts containing said assembly aiding part in the contact pin through-holes in said movable locking part;

moving said movable locking part with respect to said stationary base part to forcibly insert said assembly-aiding part and said contact part into each of said plurality of contact pin through-holes while detaching said assembly-aiding part from said composite to form a contact pin thereby.

2. The method of assembling a connector as claimed in claim 1 wherein said plurality of pin terminals to be joined to the board are press-fitted into said plurality of pin terminal through-holes provided in said stationary base part with a force caused by a movement of said movable lock part.

3. The method of forming a connector as claimed in claim 1, including the step of forming said contact pin through-holes with a narrowed part and said assembly-aiding part with a notch part near the end of said contact part, and removing said assembly-aiding part by inserting said assembly-aiding part, together with said contact part, with a force into the narrowed part at each of said plurality of contact pin through-holes whereby said notch part is broken with a force exerted by said narrowed part which is in contact with said notch part.

4. The method of assembling a connector as claimed in claim 3, wherein said plurality of pin terminals to be joined to the board are press-fitted into said plurality of pin terminal through-holes provided in said stationary base part with a force caused by a movement of said movable lock part.

* * * * *